United States Patent [19]

Nichols

[11] Patent Number: 4,504,001

[45] Date of Patent: Mar. 12, 1985

[54] SWIVEL CONNECTED BELT HOLSTER

[75] Inventor: Richard D. E. Nichols, Fallbrook, Calif.

[73] Assignee: Bianchi International, Temecula, Calif.

[21] Appl. No.: 519,049

[22] Filed: Aug. 1, 1983

[51] Int. Cl.[3] ..... B41C 33/02

[52] U.S. Cl. ..... 224/198; 224/911

[58] Field of Search ..... 224/197, 198, 911

[56] References Cited

U.S. PATENT DOCUMENTS

| | | | |
|---|---|---|---|
| 3,117,708 | 1/1964 | Goldman | 224/198 |
| 3,168,972 | 2/1965 | Parlante et al. | 224/198 |
| 3,434,638 | 3/1969 | Beynon | 224/197 |
| 3,610,487 | 10/1971 | Campos | 224/198 |
| 3,894,667 | 7/1975 | Baldocchi | 224/198 X |
| 3,915,361 | 10/1975 | Perkins | 224/198 X |
| 4,253,592 | 3/1981 | Anderson | 224/198 |

*Primary Examiner*—Steven M. Pollard

*Attorney, Agent, or Firm*—John E. Wagner

[57] ABSTRACT

A holster which comprises a holster body having on its inner face a fastener part which constitutes the pivot axis for the holster body. A rigid plate surrounds the fastener part and includes a number of detents in a circular array. A belt loop assembly includes a pair of snap fasteners to allow the belt loop to be opened and closed to encircle a section of the wearer's belt. The snap fasteners themselves have one part secured to a rigid plate which includes a circular array of mating detents. The rigid plate of the belt loop includes the mating fastener part for the mating fastener part affixed to the holster body. The fastener holding the holster body to the belt loop is preferably a T nut on the holster body and a mating screw at the belt loop.

The T nut and screw provide a central pivot for the holster body with respect to the belt loop and the mating detent parts, one on the holster body and one on the belt loop providing the adjustment feature. When the screw is tightened against the T nut, the holster body position is secured.

Ideally, one of the rigid parts includes approximately 16 detent recesses spaced equally about a circle and the mating part includes a number or detent points to engage the recesses. 16 detent recesses allows adjustment in 15 degree increments, found to be more than adequate for the precise angle which the wearer may desire.

8 Claims, 11 Drawing Figures

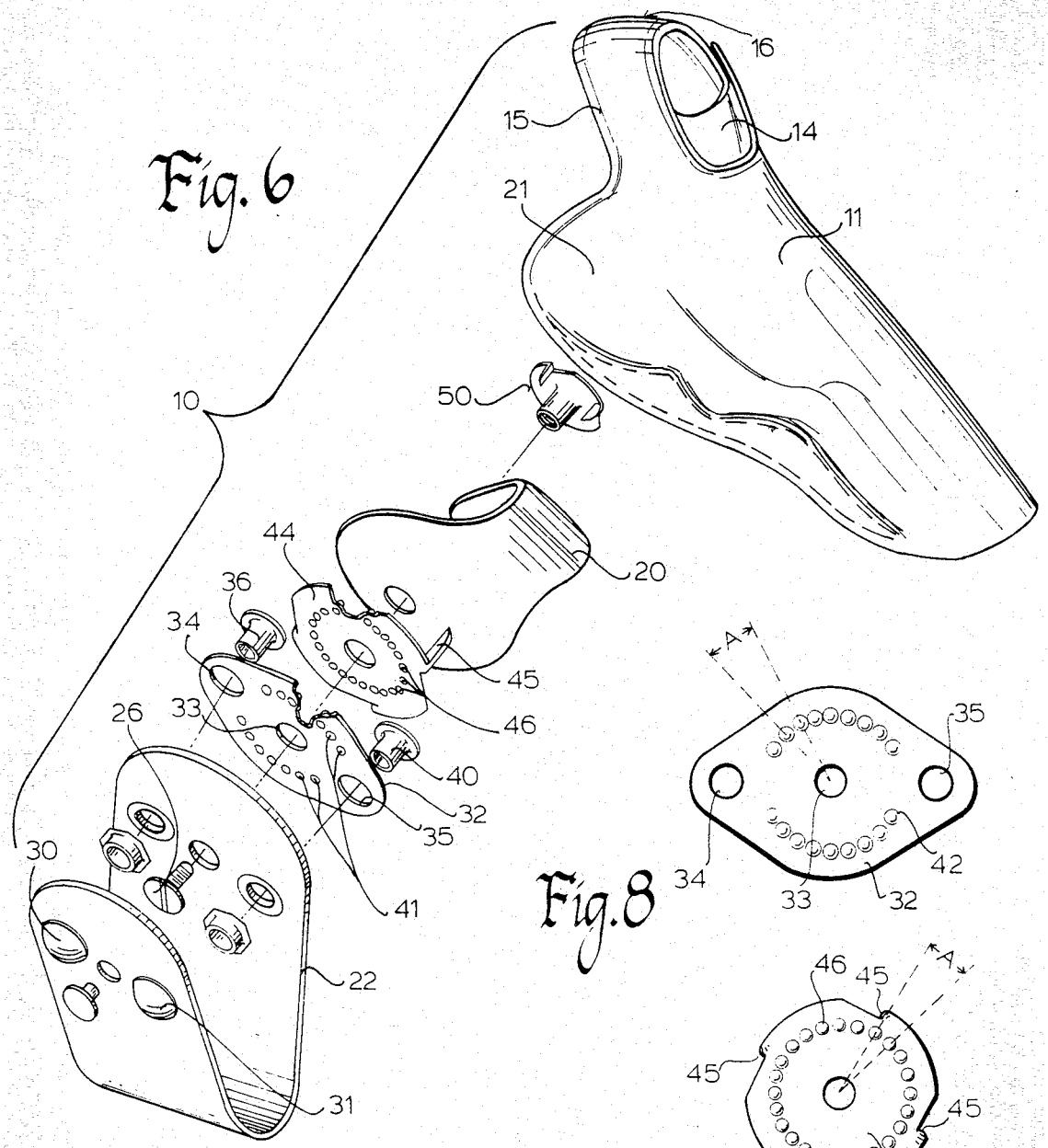
Fig. 6
Fig. 8
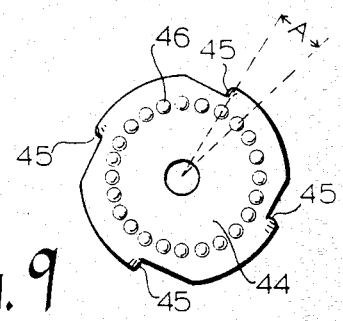
Fig. 9
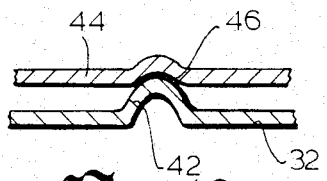
Fig. 10

SWIVEL CONNECTED BELT HOLSTER

BACKGROUND OF THE INVENTION

There has been a well recognized need for improved law enforcement holsters which are small, compact and concealable and yet worn on the belt. These holsters are customarily worn by plainclothes officers for carrying their primary handgun weapon. As a result, the officers are quite adamant about the need for the holster to properly and securely carry the handgun, and more particularly to allow for its rapid drawing without interference with their outer clothing. They want a solid feeling of attachment of the holster to their belt, ease of drawing and particularly drawing at the correct angle. The correct angle of the holster body with respect to the wearer's belt is primarily a matter of choice but of extreme importance since a law enforcement officer's life may depend upon his rapid and positively controlled draw of his handgun.

In the past, small concealable holsters have been designed to carry either revolvers or automatics with the barrel angled forward at an acute angle. This arrangement has been found to be acceptable to many officers and many thousands of such holsters have been used for many years. Despite its lack of adjustability of the cant angle of the barrel, this type of holster provides true positive connection between the belt loop and the holster body giving a solid feeling when the handgun is drawn.

Holsters have been designed with two or three different angle positions of the holster body with respect to the belt loop but characteristically have required a partial disassembly of the holster for adjustment of the angle and only limited adjustability.

Another approach taken in holsters of this type is to provide a pivoting connection between the belt loop and the holster body. Since belt loops may be secured to holster bodies by snaps, for example the one-way snap fasteners long used in holster manufacture, they can be made to act as swivels allowing total angular freedom for the holster body and handgun with respect to the belt loop and consequently the wearer's belt. A degree of acceptance for this type of holster exists since each officer can draw the handgun at the angle which feels most comfortable to him. Many officers reject this type of holster since the solid feeling of control which they desire is lacking. The handgun may pivot while being worn or during strenuous activity and most important during drawing. The rotating holster body may interfere with optimum drawing or at least psycholgically bother the officer. Therefore, the pivoting body holster does not meet the needs of adjustability of angle and solid connection between the holster body and the belt loop.

As a result, a continuing need has existed for a holster which provides both of these features.

BRIEF DESCRIPTION OF THE DRAWING

This invention may be more clearly understood from the following detailed description and by reference to the drawing in which:

FIG. 6 is an exploded view of the holster of this invention;

FIG. 8 is a front elevational view of one metal plate of this invention used for angular adjustment of the holster;

FIG. 9 is a front elevational view of the second mating metal plate of the adjusting mechanism; and FIG. 10 is an enlarged fragmentary sectional view through the mating detents of the first and second metal plates of the adjusting mechanism of this invention.

DETAILED DESCRIPTION OF THE INVENTION

Figure 1:
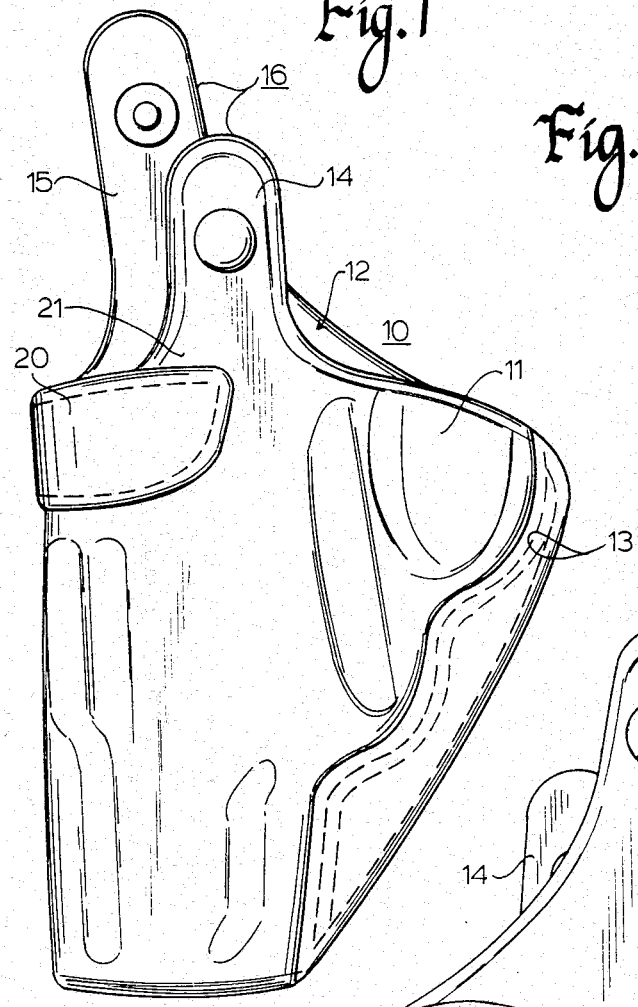
FIG. 1 is a side elevational view of a holster incorporating this invention.
Figure 2:
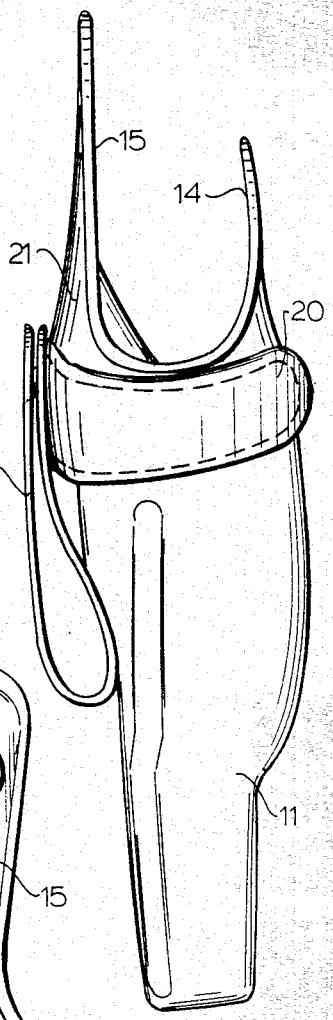
FIG. 2 is a front elevational view thereof.
Figure 3:
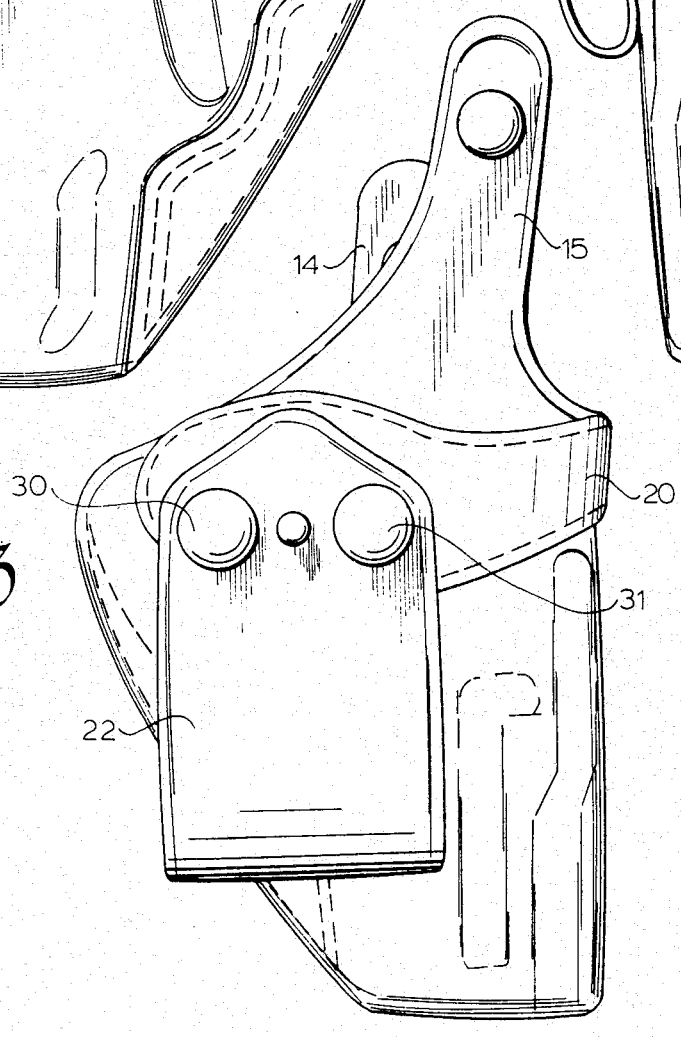
FIG. 3 is a back side elevational view thereof.
Figure 4:
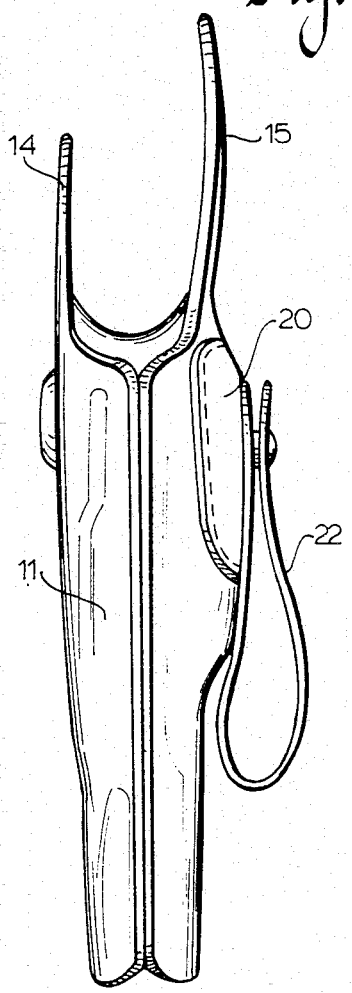
FIG. 4 is a rear elevational view thereof.

Now referring to FIGS. 1 through 4, a concealment holster 10 is illustrated, designed for belt wearing, either outside or, preferably, within the waistband of a plainclothes officer's trousers. The holster 10 includes a body 11 of leather or leather-like material which defines a pocket 12 for carrying a handgun, unshown in the drawing.

The holster body 11 is formed to match the configuration of the handgun barrel, frame and trigger guard as is particularly apparent in FIG. 1. Stitch lines 13 close the rear of the holster and they likewise include two stitch lines which follow the outline of the particular handgun for which the holster is designed.

The holster body 11 includes a pair of upward extensions 14 and 15 which define a thumbsnap releasable over-the-hammer retainer strap, generally designated 16. A reinforcing leather strap 20 is stitched to the upper edge region 21 of the holster body 11 giving double thickness to the body in the region where the handgun enters the holster pocket. This strap 20 serves another and even more important function with respect to this invention. Strap 20 conceals the adjusting and fastening features of the holster and prevents metal to metal contact within the holster pocket between the handgun and any fastener parts. The strap 20 forms the region of attachment of the belt loop assembly 22, best seen in FIGS. 3 and 6.

Figure 5:
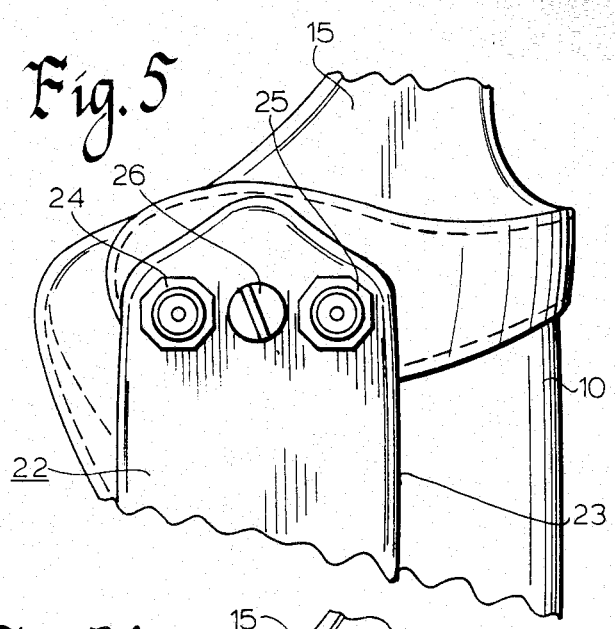
FIG. 5 is a fragmentary back side elevational view of the holster of FIG. 1 with the belt loop unsnapped to show its fastener parts and the angle adjusting screw.
Figure 5A:
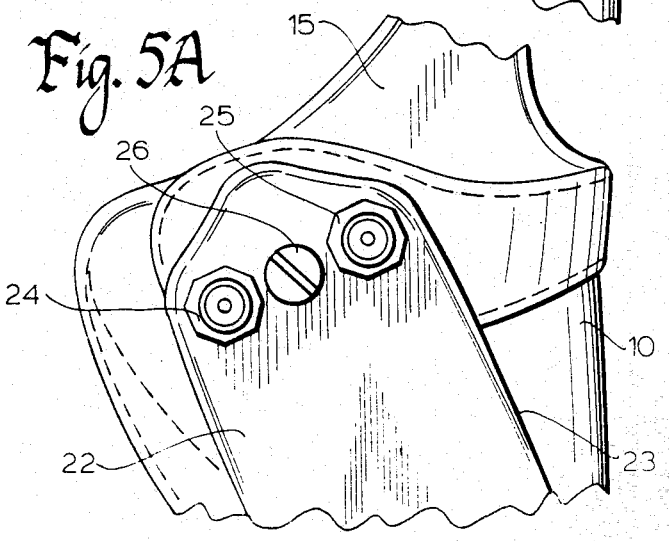
FIG. 5A is a fragmentary back side elevational view similar to FIG. 5 with the holster body at a different angle than in FIG. 5.

FIGS. 1–4 show what appears to be a conventional fixed or swivel belt loop concealment holster. FIGS. 5 and 5A, however, show that the holster body is, in fact, adjustable in angle with respect to the belt loop assembly 22. In FIG. 5, the front of the holster body parallels the front edge 23 of the belt loop assembly 22. In FIG. 5A, the holster body 12 is canted rearward with respect to the belt loop by approximately 15 degrees for those officers who prefer a forward butt first draw of the handgun. FIGS. 5 and 5A show the two fixed halves of the snap fasteners 24 and 25 and the position locking screw 26. The mating button snap fasteners for 24 and 25 do not appear in FIGS. 5 and 5A but may be seen in FIG. 6 as one-way release snap fastener top buttons 30 and 31.

Referring specifically to FIG. 6, the adjusting mechanism of this invention is now for the first time visible. This illustrates that to the wearer and others viewing the holster as shown in FIGS. 1–4, there is no visible indication of the existence of the adjustment mechanism. To all intents and purposes, the holster of this invention appears as either a fixed angle or totally swivelable holster. FIG. 6, however, shows that concealed under the belt loop 22 is metal plate 32 of elongated oval shape for convenience. The plate 32 includes a central hole 33 to allow passage of the shank of screw 26 and two additional holes 34 and 35 for passage of tubular rivets 36 and 40 which secure fastener parts 24 and 25 in place. The plate 32 is securely fastened to the back side of the belt loop assembly 22 by the rivets 36 and 40.

Figure 7:
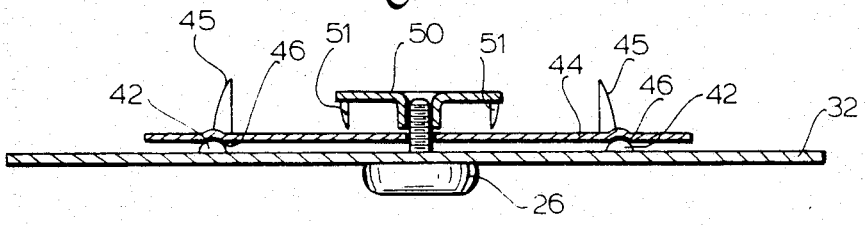
FIG. 7 is a vertical sectional view of the mating rigid plates and T nut and screw of the adjusting assembly of this invention.

Recesses 41 are apparent on the front or outer side of the plate 32. These recesses 41 are the undersides of detent bosses 42 visible in FIG. 7. The bosses 42 are in a partial circular array, numbering for example, 18, in two groups of 9, one on top and the other on the bottom. The number and location of the bosses 42 about the center defined by the screw 26 is a matter of choice. I have found that 18 bosses 42, when engaging mating recesses and held by screw 26, give excellent rigid angular positioning of the holster body 11 with respect to the belt loop assembly 22.

Underlying the plate 32 is a second plate 44 having a central hole for passage of screw 26, edge prongs 45 for securing the plate 44 to the strap 20 and, most importantly, a circular array of recesses 46 which mate with the bosses 42 of plate 32.

The actual shape and relative sizes of the plates 32 and 44 are illustrated in FIGS. 8 and 9 respectively. Plate 32 is elongated with holes 34 and 35 to receive rivets 36 and 40. The rivets 36 and 40 by passage through the openings 34 and 35 insure that the plate 32 is securely fastened to the belt loop assembly 22 and that the angular position of the holster body 11 by the bosses or detents 42. It can be seen in FIG. 8 that the bosses 42 are positioned at angular displacement of angle A. The preferred value for angle A is 15 degrees. Smaller values are desirable but tend to be limited by the ductility of the metal used in the plates 32 and 44. I have used plates with the value of angle A equal to 22 degrees but find that 15 degree increments of adjustment to be optimum.

FIG. 9 shows the plate 44 with its mating recesses 46. The prongs 45 are not directly visible but can be determined to have been sheared from the periphery of the plate 44 to form integral fasteners whch secure the plate 44 to the holster body 11 via strap 20 as illustrated in FIG. 6. The recesses 46 are similarly placed at angle A intervals and at the same radial distance from the center so that all of the bosses 42 of plate 32 rest in respective recesses 46 in plate 44 when the holster is assembled and screw 26 of FIG. 6 tightened.

The mating relationship is best illustrated in FIG. 10. The bosses 42 are taller than the recesses 46 are deep so that each boss bottoms out to insure positive locking of the two plates 32 and 44 together. I have found that the bosses 42 and recesses 46 should have matching radii on their mating surfaces but greated height on the bosses 42 than the recesses 46. This provides large area contact when the holster is adjusted and ready for use.

The entire assembly is secured as illustrated in FIG. 6 by the engagement of the screw 26 with T nut 50 which is held by its prongs 51 to the underside of strap 20. The shank of T nut 50 extends through hole 52 in strap 20. When screw 26 is tightened, eighteen bosses engage their respective equally spaced recesses for positive rigid connection between the belt loop assembly 22 and the holster body 11. When screw 26 is backed off sufficiently for relative movement between the two, the officer may move the holster body from position to position until just the right feel is encountered. This adjustment may be made while the holster is being worn by merely unsnapping the outer flap of the belt loop 22 for access to screw 26. A screw driver or coin may be used to back off the screw 26. The positional and angular adjustment is made, the screw 26 is tightened and the belt loop 22 resnapped together. Thus, field adjustments may be easily made in a matter of a few seconds. This provides large area contact when the holster is adjusted and ready for use. The positive solid feeling of the holster wanted by officers is thereby achieved. The officer may thereafter be assured that he has a solid rigid holster at the angle selected by himself.

The foregoing describes the preferred embodiment of this invention however the specific embodiment shown and described shall not be considered as limiting but rather illustrative. This invention is, instead, defined by the following claims including their equivalents.

I claim:

1. An angle selectable belt loop supported holster comprising:
   - a holster body of leather or leather-like material defining a handgun carrying pouch;
   - a belt loop assembly for attaching to a wearer's belt;
   - means for securing the belt loop to the holster body for selectably angular positioning of the holster body with respect to the belt loop;
   - said securing means defining a central pivot about which the holster may be rotated with respect to the belt loop;
   - two part detent means for limiting the angular positions of said holster body when said securing means is engaged; and
   - two part snap means engaging said belt loop to open and close said belt loop, one of said two part snap means securing one part of said two part detent means to said belt loop between said belt loop and said holster body.

2. The combination in accordance with claim 1 wherein said securing means comprises a screw and nut with one associated with the belt loop assembly and the other with the holster body and wherein said screw and nut bring said detent means into engagement;
   - said screw located within said belt loop accessable by disengaging said snap means.

3. The combination in accordance with claim 1 wherein said detent means are each formed on plates, one secured to the belt loop assembly by said snap means and the other to the holster body.

4. The combination in accordance with claim 1 wherein said detent means includes a plurality of mating bosses and recesses and wherein said bosses are of greater height than the depth of the recesses.

5. The combination in accordance with claim 1 wherein said detent means comprises a pair of plates, one of said plates secured to said belt loop means and the other of said plates to the holster body between said belt loop means and said holster body, said plates including mating detent parts.

6. The combination in accordance with claim 1 including reinforcing means for said holster body, said reinforcing means overlying the outer surface of at least a part of said holster body, said reinforcing means retaining at least a part of said securing means rigid with respect to said holster body without entering the weapon pouch.

7. The combination in accordance with claim 6 wherein said reinforcing means comprises a leather or leather-like strap partially encircling the upper region of said holster body.

8. The combination in accordance with claim 6 wherein the part of said securing means retained by said reinforcing means comprises a rigid fastener part which engages a fastener part secured to said belt loop assembly to secure the belt loop assembly and holster body together.

* * * * *